US006095783A

United States Patent [19]

Hansen et al.

[11] Patent Number: 6,095,783

[45] Date of Patent: Aug. 1, 2000

[54] FLUID MOVER

[76] Inventors: Craig N. Hansen; Paul C. Cross, both of 14920 Minnetonka Industrial Rd., Minnetonka, Minn. 55345

[21] Appl. No.: 09/027,823

[22] Filed: Feb. 20, 1998

Related U.S. Application Data

[60] Provisional application No. 60/039,684, Feb. 21, 1997.

[51] Int. Cl.[7] ..... F04C 2/00

[52] U.S. Cl. ..... 418/245; 418/251; 418/61; 418/63

[58] Field of Search ..... 418/245, 251, 418/65, 63

[56] References Cited

U.S. PATENT DOCUMENTS

| | | | |
|---|---|---|---|
| 334,235 | 1/1886 | Jurgensen . | |
| 611,239 | 9/1898 | Eaton . | |
| 647,015 | 4/1900 | Miller . | |
| 724,224 | 3/1903 | Wiechmann . | |
| 831,933 | 9/1906 | Comly . | |
| 1,001,533 | 8/1911 | Kinney . | |
| 1,261,128 | 4/1918 | Higgins . | |
| 2,215,256 | 9/1940 | Stoltz | 418/63 |
| 2,699,288 | 1/1955 | Szczepanek . | |
| 3,521,981 | 7/1970 | Krzyszczuk | 418/63 |
| 3,617,158 | 11/1971 | Yamamoto . | |
| 3,904,321 | 9/1975 | Rüedi | 418/65 |
| 4,537,567 | 8/1985 | Kawaguchi | 418/63 |
| 4,927,342 | 5/1990 | Kim | 418/63 |
| 5,102,318 | 4/1992 | Yen . | |
| 5,503,540 | 4/1996 | Kim | 418/251 |

FOREIGN PATENT DOCUMENTS

| | | |
|---|---|---|
| 24 29 456 | 1/1976 | Germany . |
| 2031520 | 4/1980 | United Kingdom . |

*Primary Examiner*—Thomas Denion
*Assistant Examiner*—Thai-Ba Trieu

[57] ABSTRACT

A pump for moving a fluid has a housing with a cylindrical internal chamber accommodating a cylindrical piston. The piston is eccentrically secured to a shaft rotatably mounted on the housing. A baffle located in a recess in the housing controls the flow of fluid through the housing from a fluid inlet passage to a fluid outlet passage. A pair of cams eccentrically mounted on the shaft linearly move cam followers connected to the baffle to maintain an end of the baffle in close relation to the piston as the piston turns in the chamber.

20 Claims, 9 Drawing Sheets

FLUID MOVER

This application is a continuation of U.S. provisional application Ser. No. 60/039,684, filed Feb. 21, 1997.

FIELD OF THE INVENTION

The invention relates to fluid pumps, such as blowers and superchargers for internal combustion engines, and other processes requiring large volumes of fluid of relatively low pressure.

BACKGROUND OF THE INVENTION

In an internal combustion engine a boost in horsepower can be accomplished by forcing a more dense air/fuel charge into the cylinders with a supercharger. A supercharger provides a simple, dependable and affordable method of increasing horsepower and torque.

A supercharger forces a more dense air/fuel mixture into an engine's cylinders than the engine can draw in under normal conditions. This higher-energy mixture produces more power. Supercharging increases the engine's volumetric efficiency without increasing its displacement. Therefore, a small engine can produce the horsepower and torque of a relatively larger engine.

There are three basic blower systems available: turbocharging, positive displacement supercharging, and turbine-type supercharging. Turbocharging places a turbine wheel in the exhaust flow. The turbine blades are directly connected to a centrifugal blower. One major disadvantage of a turbocharger is "turbo-lag." This is the delay that occurs after calling for power with the throttle before the rotational speed of the system "spools up" to deliver that power. Turbochargers are difficult systems to properly adapt and tailor to an engine. An improperly sized or designed turbo system can rapidly over-boost and ruin a spark-ignited engine. The "sizing" of the turbo to the engine, and the matching of the turbine size and design to impeller size and design is very critical in a turbo application. Additionally, the exhaust turbine tends to cool the exhaust gases thereby delaying the catalyst "light-off" of modern automotive emissions systems.

The most common positive displacement system is the "Roots blower" in which a belt-driven shaft drives two close-tolerance rotors which are geared together. Each full rotation sweeps out a specific fixed volume, unlike the fan-like characteristics of a turbine device.

Turbine-type supercharging is a system having a drive-belt from the crankshaft. A speed-increaser, either geared or gearless, is required to multiply the speed of the turbine impeller relative to that of the input shaft. The delivery of a turbine-type device varies dramatically with its rotational speed, and is prone to under-boost at low speed and over-boost at high speed. An example of a centrifugal turbine supercharger is disclosed by M. Shirai in U.S. Pat. No. 5,158,427.

SUMMARY OF THE INVENTION

The invention is directed to a fluid pump having an eccentric piston attached to a shaft rotatably mounted on a housing. A baffle mounted on the housing separates a fluid intake passage from a fluid exhaust passage. Cams operatively coupled to the shaft and connected with cam follower members attached to the baffle control the movement of the baffle in conjunction with movement of the eccentric piston. Rotation of the shaft turns the eccentric piston and reciprocates the baffle to maintain the baffle in close relation with the outer surface of the piston. The cam follower members connected to the baffle have reciprocating linear movements which do not subject the baffle to lateral and twisting forces. The turning piston moves a large volume of relatively low pressure fluid through the housing. The fluid pump is suitable for an internal combustion engine supercharger which is belt or motor-driven.

DESCRIPTION OF THE PREFERRED EMBODIMENT

Figure 1:
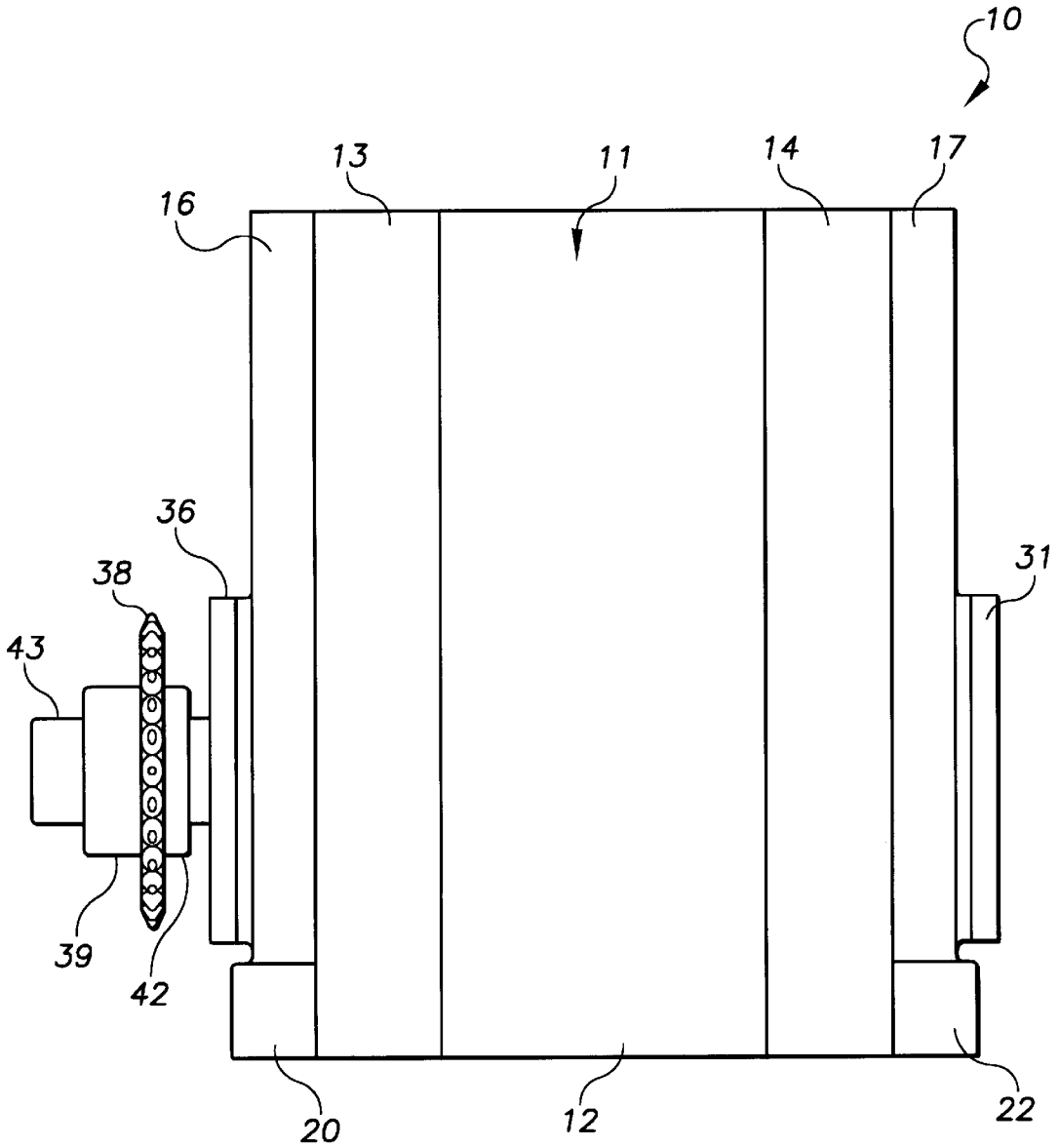
FIG. 1 is a side elevational view of the fluid mover of the invention.
Figure 2:
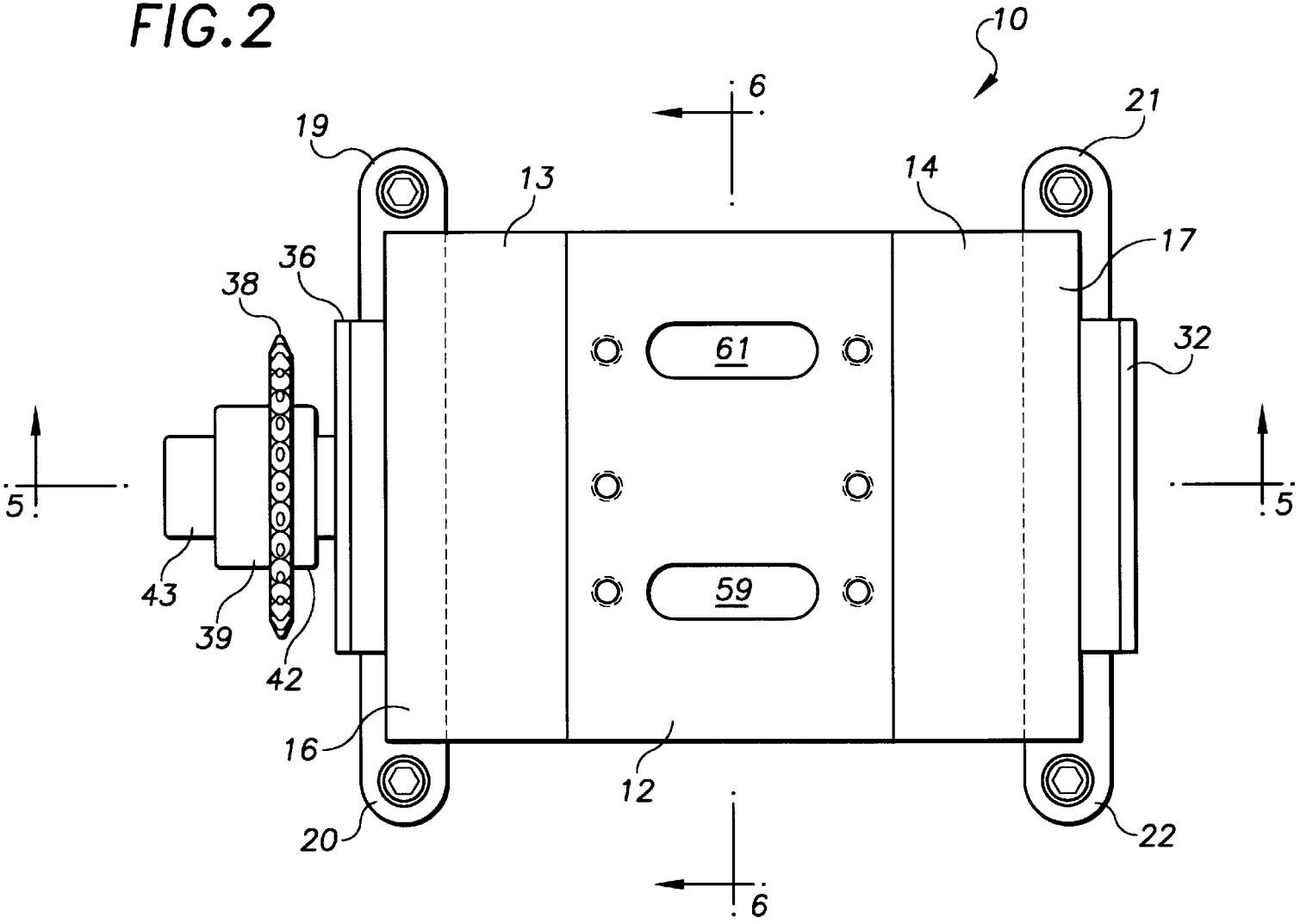
FIG. 2 is a top plan view of the fluid mover of FIG. 1.

Referring to the drawings, there is shown in FIGS. 1 to 4 the pump of the invention indicated generally at 10. Pump 10 is operable to move a large volume of fluid, such as air, to a desired location. For example, the pump can be used as a supercharger to provide a continuous and pressurized source of an air or air/fuel mixture to an internal combustion engine to increase horsepower, torque and volumetric efficiency of the engine. Pump can also be used to move other types of gases and liquids to selected locations. The following description is directed to a supercharger for an internal combustion engine.

As shown in FIGS. 1 to 4, pump 10 has a generally rectangular housing 11 comprising a central body 12, end members 13 and 14, and end plates 16 and 17 secured together with a plurality of fasteners 18, shown as bolts. End plates 16 and 17 have outwardly directed members or feet 19, 20 and 21, 22 adapted to be secured to a support.

Figure 5:
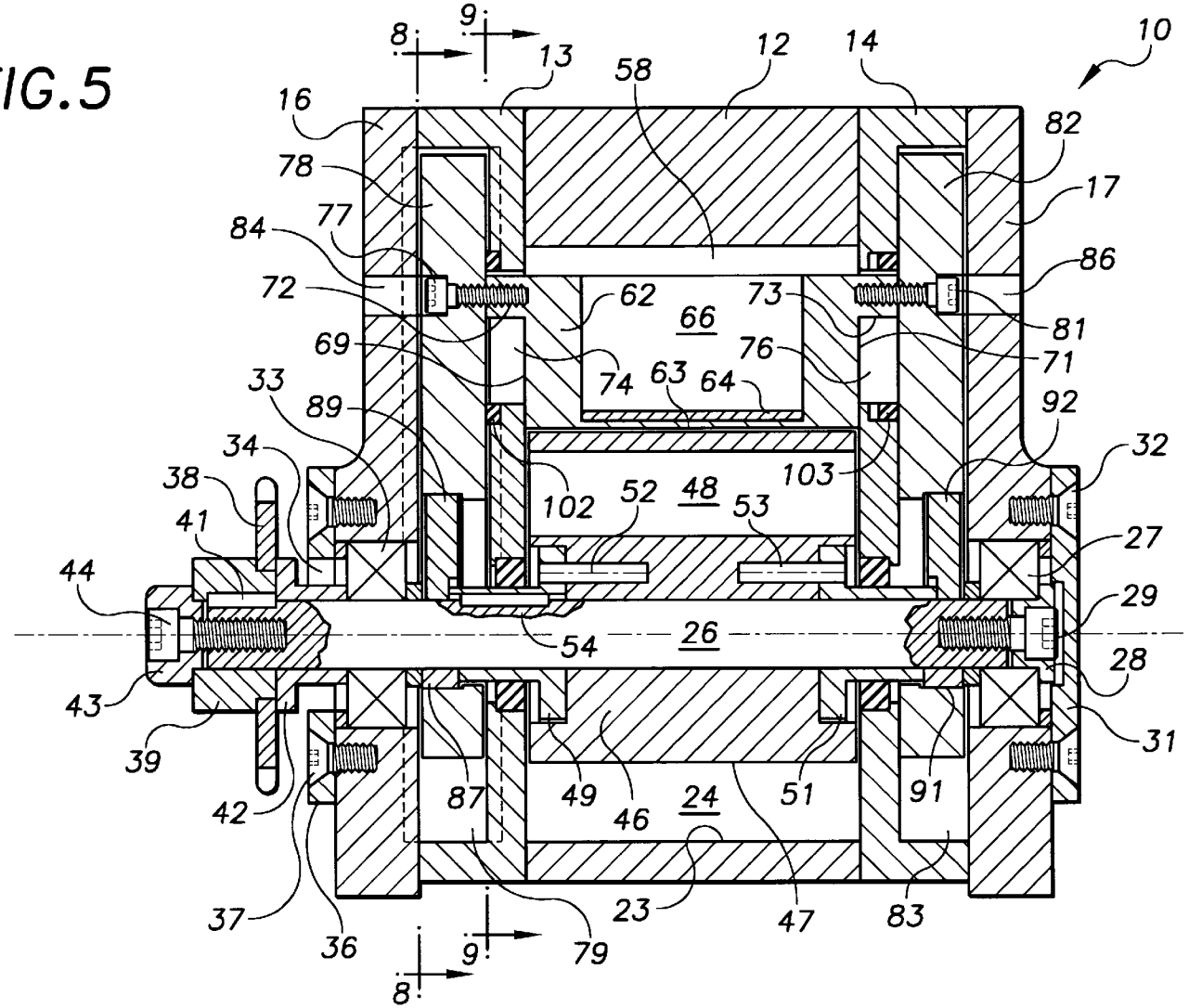
FIG. 5 is a sectional view taken along line 5—5 of FIG. 2.

As shown in FIG. 5, body 12 has an internal cylindrical wall 23 surrounding a chamber 24. Wall 23 has a machined cylindrical smooth surface. A shaft 26 extends through chamber 24 along the central axis of chamber 24. One end of shaft 26 is rotatably supported with a bearing 27 on end plate 17. A sleeve 28 secured to the end of shaft 26 with bolt 29 holds shaft 26 in assembled relation with bearing 27. A cap 31 mounted on end plate 17 with bolts 32 covers the end of shaft 26 and bearing 27 to prevent dirt and moisture contamination. The opposite end of shaft 26 is mounted on end plate 16 with a bearing 33. Shaft 26 extends through an opening 34 in an annular cap 36 secured to end plate 16 with bolts 37. Cap 36 retains bearing 33 in assembled relation with end plate 16.

A drive sprocket 38 having a hub 39 is splined to shaft 26 with a key 41. Hub 39 bears against a sleeve 42 spacing the hub from bearing 33. A washer 43 secured to shaft 26 with bolt 44 engages hub 39 to hold hub 39 on shaft 26.

Figure 3:
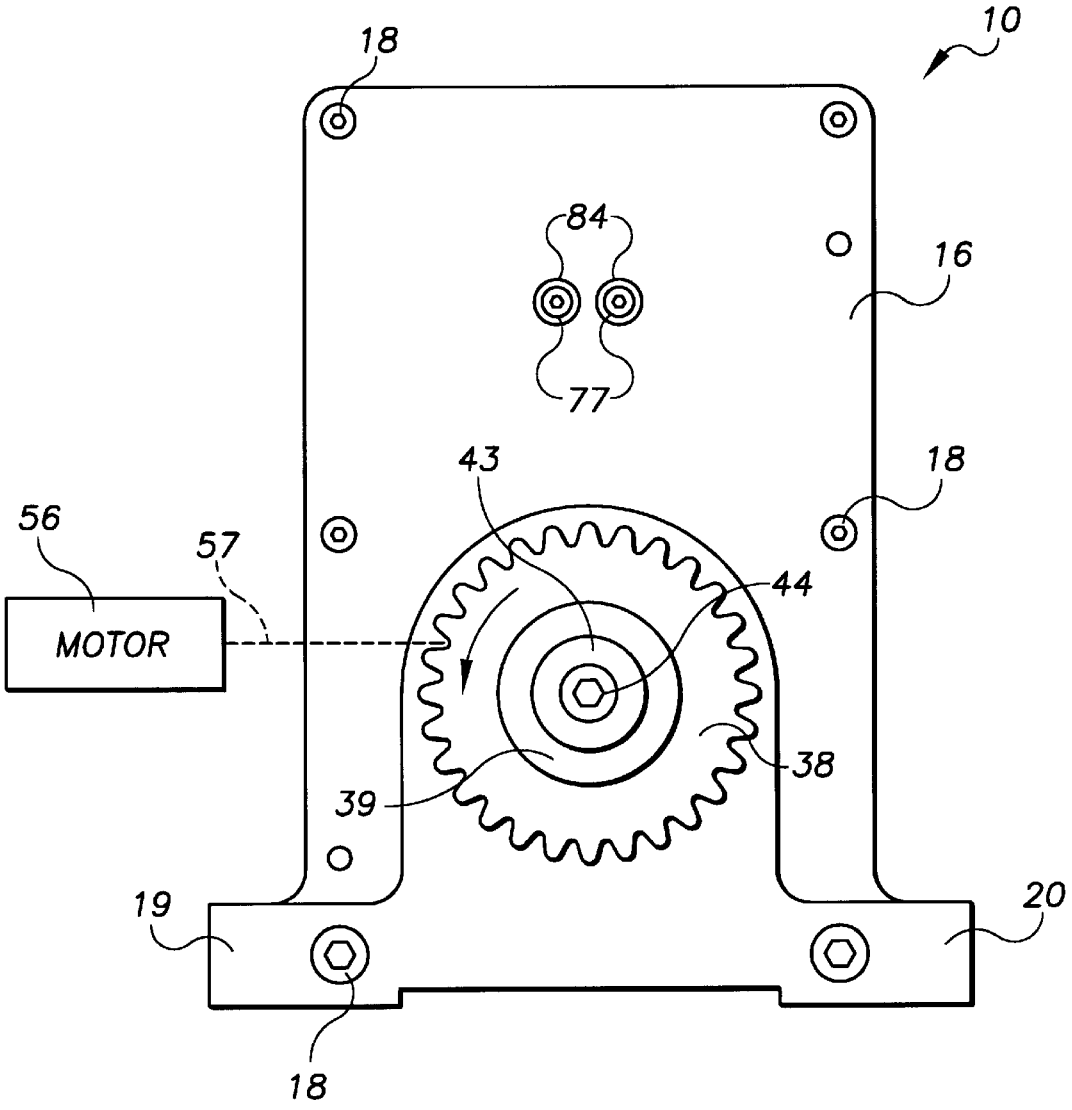
FIG. 3 is a side elevational view of the left or power input side of the fluid mover of FIG. 1.
Figure 4:
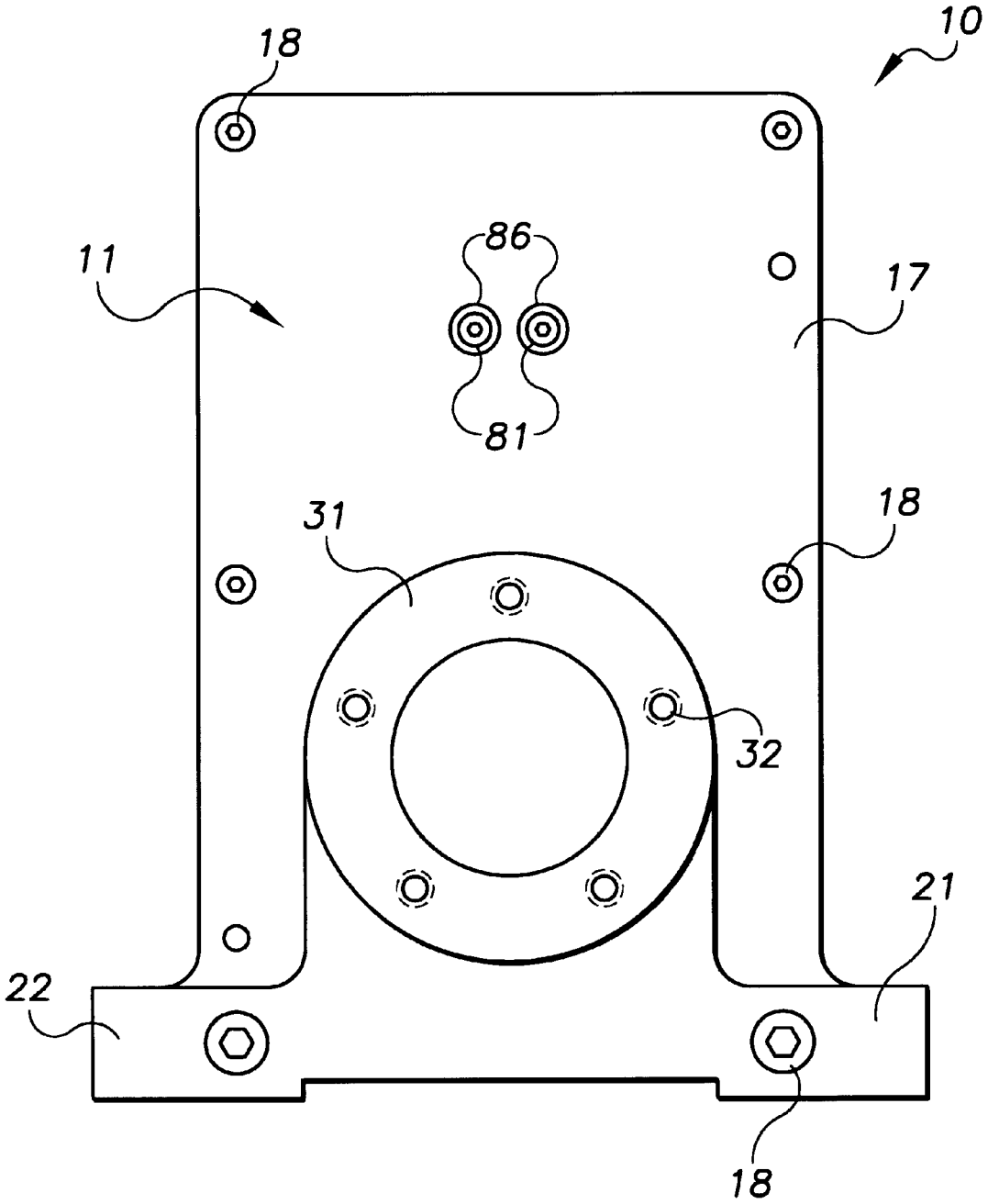
FIG. 4 is a side elevational view of the right side of the fluid mover of FIG. 1.

An eccentric member or cylindrical piston 46 having an outer cylindrical wall 47 is mounted on shaft 26. Piston 46 has an axis offset from the axis of shaft 26. The diameter of piston 46 is smaller that the diameter of cylindrical wall 23 and has an arcuate segment located in close relationship to a sector of wall 23 as piston 46 turns in chamber 24. Piston 46 has a cavity 48 in the offset portion of piston 46 to dynamically balance piston 46 and cams 89 and 92 as they turn with shaft 26. Piston 46 is secured to shaft 26 with a pair of sleeves 49 and 51 accommodating pins 52 and 53. Sleeve 49 is keyed to shaft 26 with a key 54. Sleeve 51 is also keyed to shaft 26. Shaft 26 is driven with a motor 56, as shown in FIG. 3, drivably connected to sprocket 38 with a roller chain 57. Other types of power transmission structures can be used to drivably connect motor 56 to shaft 26.

Figure 6:
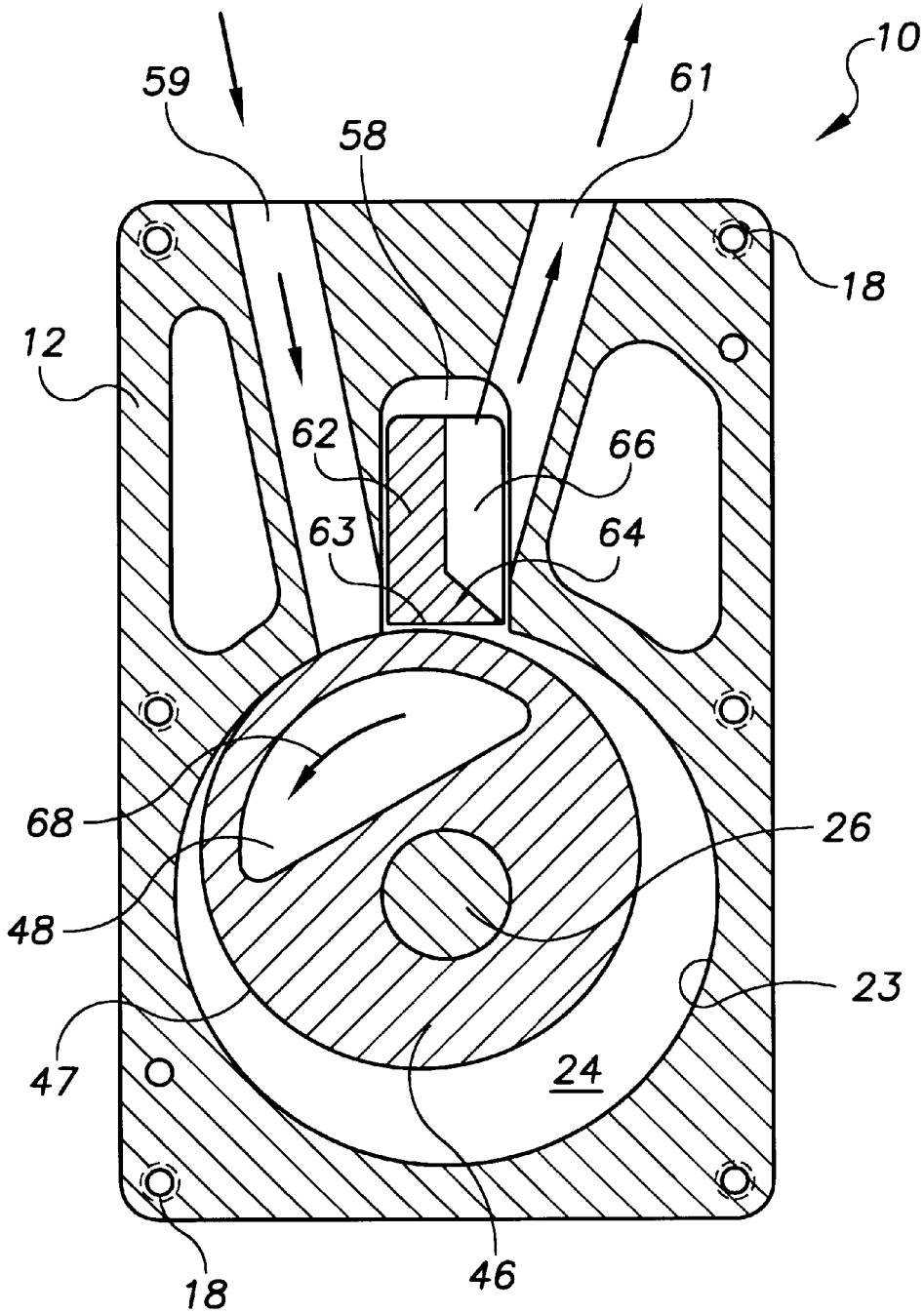
FIG. 6 is a sectional view taken along line 6—6 of FIG. 2.

As shown in FIGS. 5 and 6, body 12 has a groove or cavity 58 open to the top of chamber 24. Cavity 58 is located adjacent an air intake passage 59. An air exhaust passage 61 is open to one side of cavity 58. Passages 59 and 61 are in body 12 and extend to an air intake device and an air receiver, such as the intake manifold of internal combustion engine.

A baffle 62 located in cavity 58 separates air intake passage 59 from air exhaust passage 61. Baffle 62 has a flat inner wall or bottom face 63 located in close relationship with the outside wall 47 of piston 46. As shown in FIG. 5, face 63 extends across chamber 24 to adjacent inside walls of end members 13 and 14. The clearance between face 63 and wall 47 is in the range of 0.001 to 0.0001 inch. The close tolerance between face 63 and wall 47 substantially blocks the flow of air past baffle 62 with a minimum of interference to the rotation of piston 46 and maximum air pumping efficiency. A coating or layer of wear resistant material, such as high density plastic or metal, can be applied to face 63 to reduce wear and erosion.

The lower portion of baffle 62 has an outwardly tapered nose 64. The bottom of nose 64 is co-extensive with bottom face 63. An upwardly extended recess or groove 66 in baffle 62 above nose 64 is open to air exhaust passage 61 to allow air to flow from chamber 24 past baffle 62 into exhaust passage 61 during rotation of piston 46 in the direction of arrow 68, shown in FIGS. 6 and 7.

As shown in FIG. 5, baffle 62 has flat upright end walls 69 and 71 and outwardly directed projections or ears 72 and 73. Ears 72 and 73 extend into openings 74 and 76 in end members 13 and 14. A first pair of bolts 77 secure ear 72 to a first cam follower member 78. The pair of bolts 77 prevent all relative movement between baffle 62 and member 78. Cam follower member 78 is located in a rectangular pocket 79 in end member 13 which permits only linear up and down movement of member 78. A second pair of bolts 81 secure ear 73 to a second cam follower member 82. The pair of bolts 81 prevent all relative movement between baffle 62 and member 82. Cam follower member 82 is located in a rectangular pocket 83 in end member 14. Pocket 83 has the same shape as pocket 79 shown in FIG. 8. End plates 16 and 17 secured to end members 13 and 14 close pockets 79 and 83. Holes 84 and 86 in end plates 16 and 17 aligned with pairs of bolts 77 and 81 permit bolts 77 and 81 to be tightened without removing end plates 16 and 17.

Figure 8:
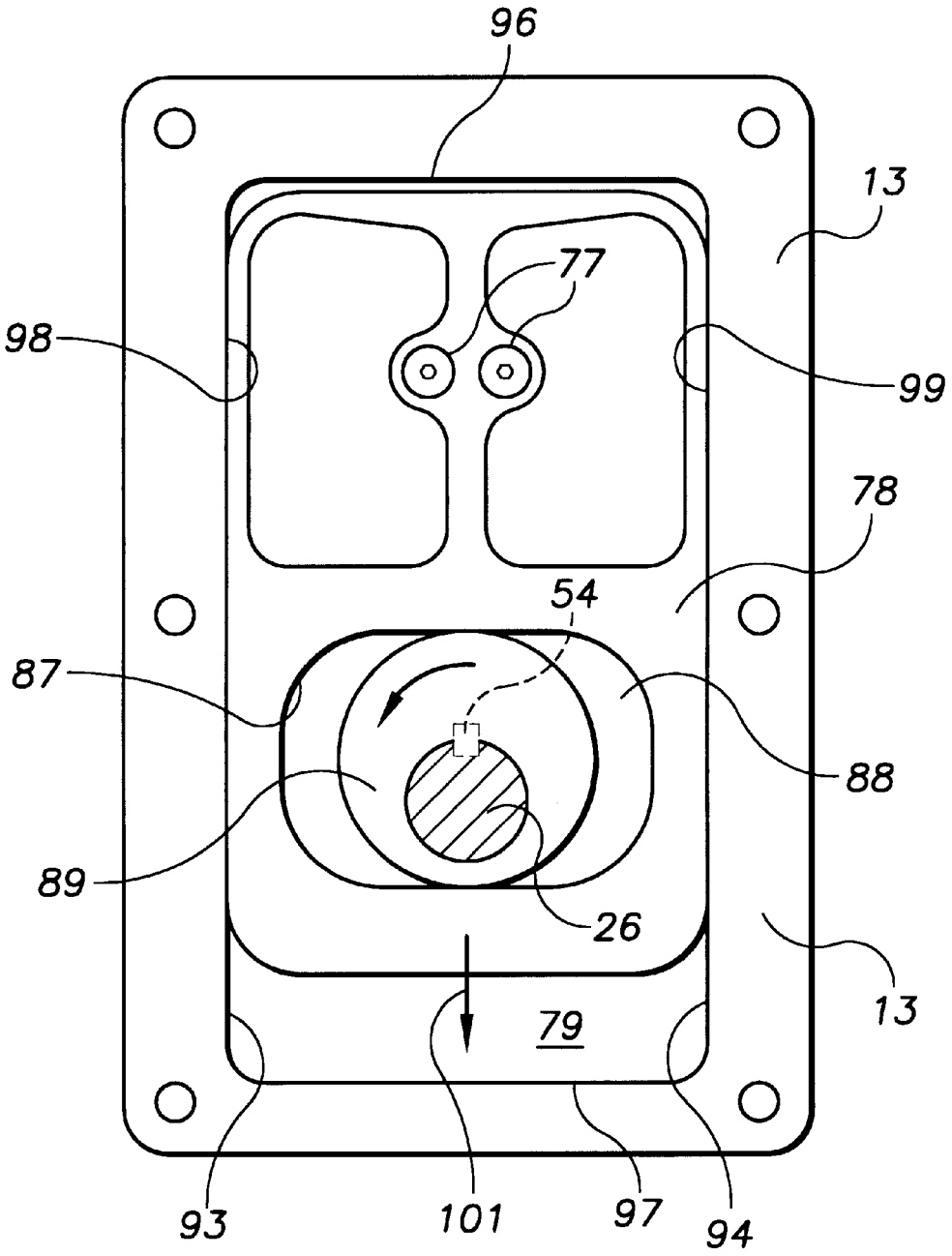
FIG. 8 is a sectional view taken along the line 8—8 of FIG. 5.

As shown in FIG. 8, cam follower member 78 has an inside wall 87 having a generally ovaloid shaped surface surrounding an opening 88. Wall 87 has flat upper and lower surfaces that are engaged with a cylindrical cam 89. Cam 89 is keyed to shaft 26 as shown in FIG. 5. Cam 89 is eccentrically mounted on shaft 26 with the same circumferential orientation as piston 26. Cam follower member 82 has an inside wall 91 having the same shape as wall 87 engaged with a cylindrical cam 92. Cam 92 keyed to shaft 26 has the same shape and circumferential orientation as cam 89.

As shown in FIG. 8, end plate 13 has upright parallel linear inside walls 93 and 94 and upper and lower inside walls 96 and 97 surrounding pocket 79. Cam follower member 78 has linear outside walls 98 and 99 located in sliding engagement with walls 93 and 94. Engaging walls 93, 98 and 94, 99 have flat surfaces which limit movement of cam follower member 78 to linear reciprocating movement shown by arrow 101 upon rotation of cam 89. End plate 14 has the same inside walls surrounding pocket 83 as shown by walls 93 and 94 in FIG. 8. Cam follower member 82 has flat outside walls located in sliding engagement with the inside walls of end member 14 that limit movement of member 14 to linear reciprocating movement. Cam follower member 82 has the same structure as cam follower member 78.

Figure 9:
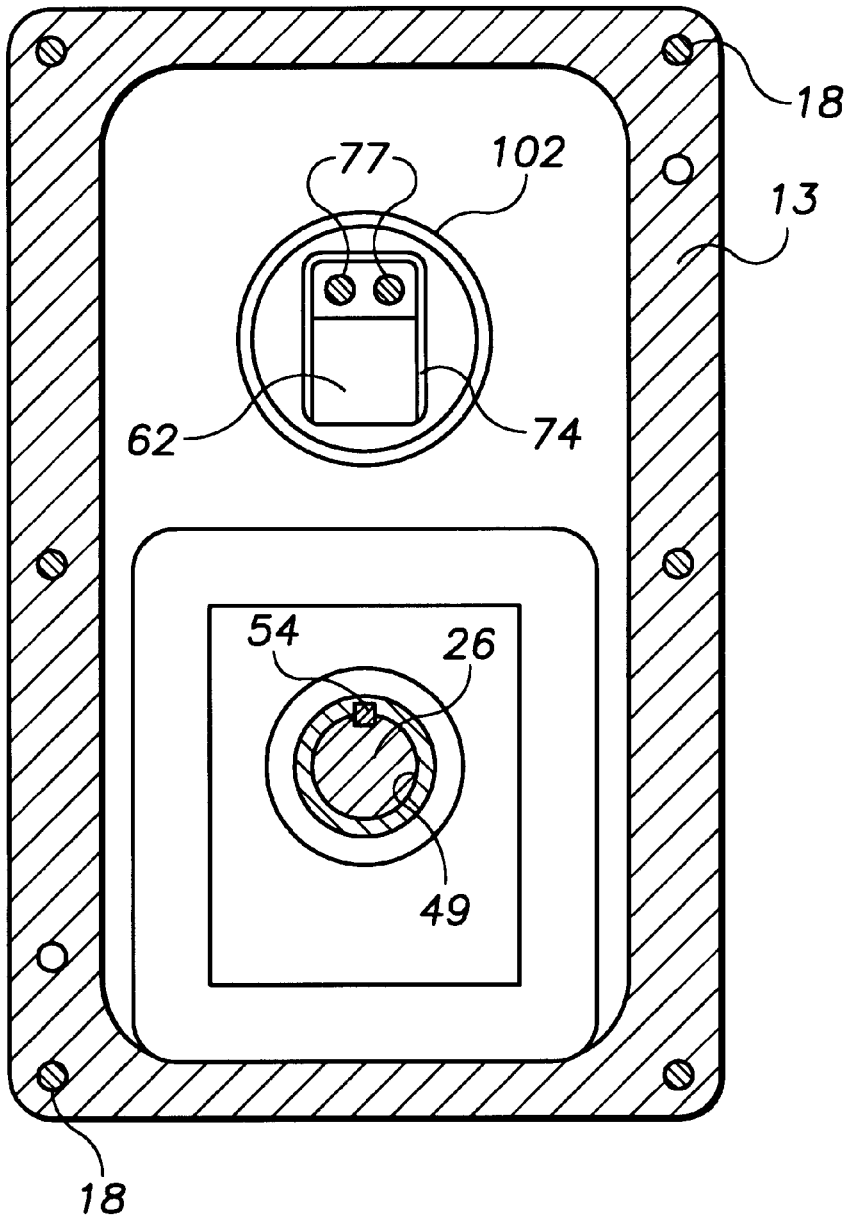
FIG. 9 is a sectional view taken along the line 9—9 of FIG. 5.

As shown in FIGS. 5 and 9, an O-ring 102 mounted in a groove in end member 13 surrounds opening 74 and engages cam follower member 78. O-ring 102 is a seal that prevents leakage of air from cavity 58 to pocket 79. End plate 14 accommodates an O-ring 103 that prevents leakage of air from cavity 58 into pocket 83.

Figure 7:
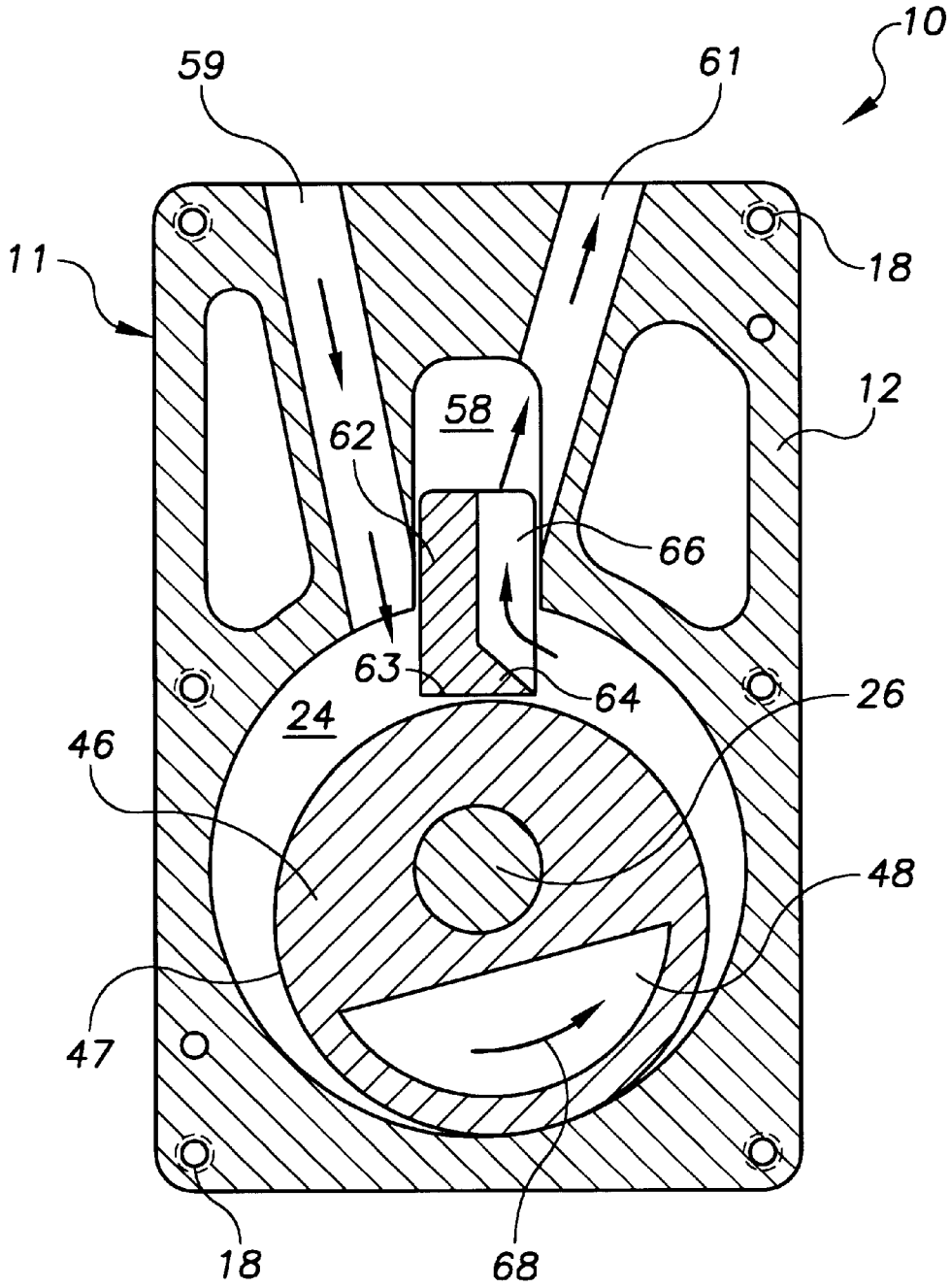
FIG. 7 is a sectional view similar to FIG. 6 showing the piston in a location opposite the location of the piston shown in FIG. 6.

Referring to FIGS. 6 and 7, motor 56 operates to turn shaft 26 thereby concurrently turn eccentric piston 46 and cams 89 and 92 in a counterclockwise direction as shown by arrow 68. Piston 46 has a section of outer wall 47 located in close relation to inside cylindrical wall 23 of body 12. This section moves around wall 23 as piston 46 turns in chamber 24 causing air to flow from air intake passage 59 into chamber 24 and forcing air out of chamber 24 past baffle 62 into air exhaust passage 61. Baffle 62 separates chamber 24 into an air intake section and an air exhaust section so that new air enters chamber 24 as the air in chamber 24 is forced out of chamber 24. Cams 89 and 92 turning about the longitudinal axis of shaft 26 only move cam follower members 78 and 82 and baffle 62 in reciprocating linear paths. Lateral and twisting forces are not imparted to baffle 62 as it tracks the outer cylindrical wall 47 of piston 46. The linear forces of cam follower members 78 and 82 are applied to opposite ends of baffle 62. These forces are equal and therefore do not subject baffle 62 to transverse swinging forces that can alter the space relationship between bottom face 63 of baffle 62 and outer cylindrical wall 47 of piston 46. Baffle 62 only moves up and down along a linear path in timed relationship with the turning of piston 46 to maintain the close relationship between bottom face 63 of baffle 62 and the outer wall 47 of piston 46 along the entire circumference of wall 47. The turning piston 46 moves a large volume of relatively low pressure air through chamber 24 with adiabatic efficiency.

The present disclosure is a preferred embodiment of the fluid mover for a supercharger for an internal combustion engine. It is understood that the fluid mover is not to be limited to the specific constructions and arrangements shown and described. It is understood that changes in parts, materials, arrangement and locations of structures may be made without departing from the invention. The invention is defined in the following claims.

What is claimed is:

1. A fluid mover comprising: a housing having a cylindrical inside wall surrounding an internal chamber, a shaft extended through the chamber, means rotatably mounting the shaft on the housing, a piston located in the chamber secured to the shaft, said piston having a cylindrical outer wall having a diameter smaller than the diameter of the inside wall of the housing and an axis offset from the axis of the shaft, said housing having a fluid intake passage and a fluid exhaust passage open to the chamber and a cavity between the intake and exhaust passages open to the chamber, baffle means located in the cavity for controlling the flow of fluid through the chamber during rotation of the piston in the chamber, said baffle means having a face located in continuous close relationship with the outer wall of the piston during rotation of the piston in the chamber, eccentric cam means secured to the shaft, and means connected to the baffle means and engageable with the cam means for moving the baffle means in the cavity to maintain the face of the baffle means in close relation to the outer wall of the piston during turning of the piston in the chamber when torque is applied to the shaft whereby the turning piston moves fluid from the fluid intake passage, through the chamber, and forces fluid out of the chamber through the fluid exhaust passage, said means connected to the baffle means comprise cam follower means located in pocket means in the housing for linear reciprocate movement, said cam follower means having a generally ovaloid shaped wall surrounding an opening accommodating the cam means, means connecting the cam follower means to the baffle means whereby rotation of the cam means moves the cam follower means and baffle means in timed relation to the piston.

2. The fluid mover of claim 1 wherein: the baffle means has an outwardly tapered nose having a surface coextensive with the face of the baffle means, said nose being located adjacent the fluid exhaust passage to direct fluid from the chamber into the exhaust passage.

3. The fluid mover of claim 2 wherein: said baffle means has a nose and a groove located above the nose and open to the fluid exhaust chamber for directing fluid into the exhaust chamber.

4. The fluid mover of claim 3 wherein: the cavity in the housing has a generally rectangular shape with a rectangular opening open to the chamber, said baffle means comprising a generally flat rectangular member located in the cavity, said face and the nose having a size to sequentially open and close the rectangular opening of the cavity during turning of the piston in the chamber.

5. The fluid mover of claim 1 wherein: the cavity has a generally rectangular shape, said baffle means comprising a plate member located in the cavity and movable to sequentially open and close the fluid exhaust passage during turning of the piston in the chamber.

6. The fluid mover of claim 5 wherein: the plate member has a nose for closing part of the fluid exhaust passage, and a groove adjacent the nose for directing fluid from the chamber into the exhaust passage.

7. A fluid mover comprising: a housing having a cylindrical inside wall surrounding an internal chamber, a shaft extended through the chamber, means rotatably mounting the shaft on the housing, a piston located in the chamber, means securing the piston to the shaft, said piston having a cylindrical outer wall having a diameter smaller than the diameter of the inside wall of the housing and an axis offset from the axis of the shaft, said housing having a fluid intake passage and a fluid exhaust passage open to the chamber and a cavity between the intake and exhaust passages open to the chamber, baffle means located in the cavity for controlling the flow of fluid through the chamber during rotation of the piston in the chamber, said baffle means having a face located in continuous close relationship with the outer wall of the piston during rotation of the piston in the chamber, eccentric cam means secured to the shaft, and means connected to the baffle means and engageable with the cam means for moving the baffle means in the cavity to maintain the face of the baffle means in close relation to the outer wall of the piston during turning of the piston in the chamber when torque is applied to the shaft whereby the turning piston moves fluid from the fluid intake passage, through the chamber, and forces fluid out of the chamber through the fluid exhaust passage, said means connected to the baffle means comprise generally flat cam follower members located in pockets in the housing adjacent opposite ends of the piston, said housing having linear walls engageable with the cam follower members to allow only linear reciprocating movement of the cam follower members, said cam follower members each having a generally ovaloid shaped wall surrounding an opening, a first cam having an eccentric outer wall located in the opening in one cam follower member, and a second cam having an eccentric outer wall located in the opening in the other cam follower member, means connecting the cam follower members to the baffle means whereby rotation of the first and second cams reciprocate the cam follower members and baffle means in timed relation with the turning of the piston in the chamber to move fluid through the chamber.

8. The fluid mover of claim 7 wherein: said baffle means has a nose and a groove located above the nose and open to the fluid exhaust chamber for directing fluid into the exhaust chamber.

9. The fluid mover of claim 8 wherein: the cavity in the housing has a generally rectangular shape with a rectangular opening open to the chamber, said baffle means comprising a generally flat rectangular member located in the cavity, said face and the nose having a size to sequentially open and close the rectangular opening of the cavity during turning of the piston in the chamber.

10. The fluid mover of claim 7 wherein: the cavity has a generally rectangular shape, said baffle means comprising a plate member located in the cavity and movable to sequentially open and close the fluid exhaust passage during turning of the piston in the chamber.

11. The fluid mover of claim 10 wherein: the plate member has a nose for closing part of the fluid exhaust passage, and a groove adjacent the nose for directing fluid from the chamber into the exhaust passage.

12. The fluid mover of claim 7 wherein: the baffle means has an outwardly tapered nose having a surface coextensive with the face of the baffle means, said nose being located adjacent the fluid exhaust passage to direct fluid from the chamber into the exhaust passage.

13. The fluid mover of claim 12 wherein: said baffle means has a groove located above the nose and open to the fluid exhaust chamber for directing fluid into the exhaust chamber.

14. A fluid mover comprising: a housing having a cylindrical inside wall surrounding an internal chamber, a shaft extended through the chamber, means rotatably mounting the shaft on the housing, a piston having a cylindrical outer wall located in said chamber, said cylindrical outer wall having a diameter smaller than the diameter of the inside wall of the housing and an axis offset from the axis of the shaft, means securing the piston to the shaft, said housing having a fluid intake passage and a fluid exhaust passage open to the chamber and a cavity between the intake and exhaust passages open to the chamber, baffle means located in the cavity for controlling the flow of fluid through the chamber during turning of the piston in the chamber, said baffle means having a portion located in continuous close relationship with the outer wall of the piston during turning of the piston in the chamber, eccentric cam means secured to the shaft for turning with the shaft, said cam means having an axis offset from the axis of the shaft, cam follower means engageable with the cam means having linear reciprocal movement in response to turning of the cam means, and means connecting the baffle means to the cam follower means whereby the baffle means moves in the cavity to maintain the portion of the baffle means in close relation to the outer wall of the piston during turning of the cam means and the piston in the chamber when torque is applied to the shaft, said turning piston moves fluid from the fluid intake passage, through the chamber, and forces fluid out of the chamber through the fluid exhaust passage.

15. The fluid mover of claim 14 wherein: the baffle means has an outwardly tapered nose having a surface coextensive with the portion of the baffle means, said nose being located adjacent the fluid exhaust passage to direct fluid from the chamber into the exhaust passage.

16. The fluid mover of claim 15 wherein: said baffle means has a nose and a groove located above the nose and open to the fluid exhaust chamber for directing fluid into the exhaust chamber.

17. The fluid mover of claim 16 wherein: the cavity in the housing has a generally rectangular shape with a rectangular opening open to the chamber, said baffle means comprising a generally flat rectangular member located in the cavity, said portion and the nose having a size to sequentially open and close the rectangular opening of the cavity during turning of the piston in the chamber.

18. The fluid mover of claim 14 wherein: the cavity has a generally rectangular shape, said baffle means comprising a plate member located in the cavity and movable to sequentially open and close the fluid exhaust passage during turning of the piston in the chamber.

19. The fluid mover of claim 18 wherein: the plate member has a nose for closing part of the fluid exhaust passage, and a groove adjacent the nose for directing fluid from the chamber into the exhaust passage.

20. The fluid mover of claim 14 wherein: the housing has pocket means for accommodating the cam follower means for linear reciprocal movement.

* * * * *